US006344175B1

(12) United States Patent
Akae et al.

(10) Patent No.: US 6,344,175 B1
(45) Date of Patent: Feb. 5, 2002

(54) METHOD AND APPARATUS FOR DECOMPOSING AN INCINERATOR

(76) Inventors: Yukoh Akae, 1-10-18, Maikosaka, Tarumi-ku, Kobe-shi, Hyogo-ken; Kazuo Kote, 1969 Kawashima-cho, Asahi-ku, Yokohama-shi, Kanagawa-ken, both of (JP)

( * ) Notice: Subject to any disclaimer, the term of this patent is extended or adjusted under 35 U.S.C. 154(b) by 0 days.

(21) Appl. No.: 09/546,694

(22) Filed: Jun. 26, 2000

Related U.S. Application Data

(62) Division of application No. 09/139,073, filed on Aug. 24, 1998, now Pat. No. 6,084,149.

(51) Int. Cl.[7] ..... B01J 19/08

(52) U.S. Cl. ..... 422/186.01; 588/220; 588/228; 204/157.15

(58) Field of Search ..... 422/186.01; 588/220, 588/228; 204/157.15

(56) References Cited

U.S. PATENT DOCUMENTS 1,601,212 A * 9/1926 Henry ..... 422/186.01
5,191,184 A * 3/1993 Shin ..... 219/10.55 R
5,393,500 A * 2/1995 Kameda et al. ..... 422/186

* cited by examiner

*Primary Examiner*—K. Mayekar
(74) *Attorney, Agent, or Firm*—Irving Keschner

(57) ABSTRACT

A melting furnace that incorporates the autoclave theory and is equipped with a high-frequency (horizontal wave) device for incinerating material and for thermal decomposition and recrystallization of organic and inorganic hazardous compounds contained in it and to detoxify hazardous substances that have been recrystallized or thermally decomposed by using specific solvents. A melting furnace to accomplish the above is provided and hazardous gas that is generated during the incineration process at high temperature and under high pressure in the furnace is treated.

13 Claims, 1 Drawing Sheet

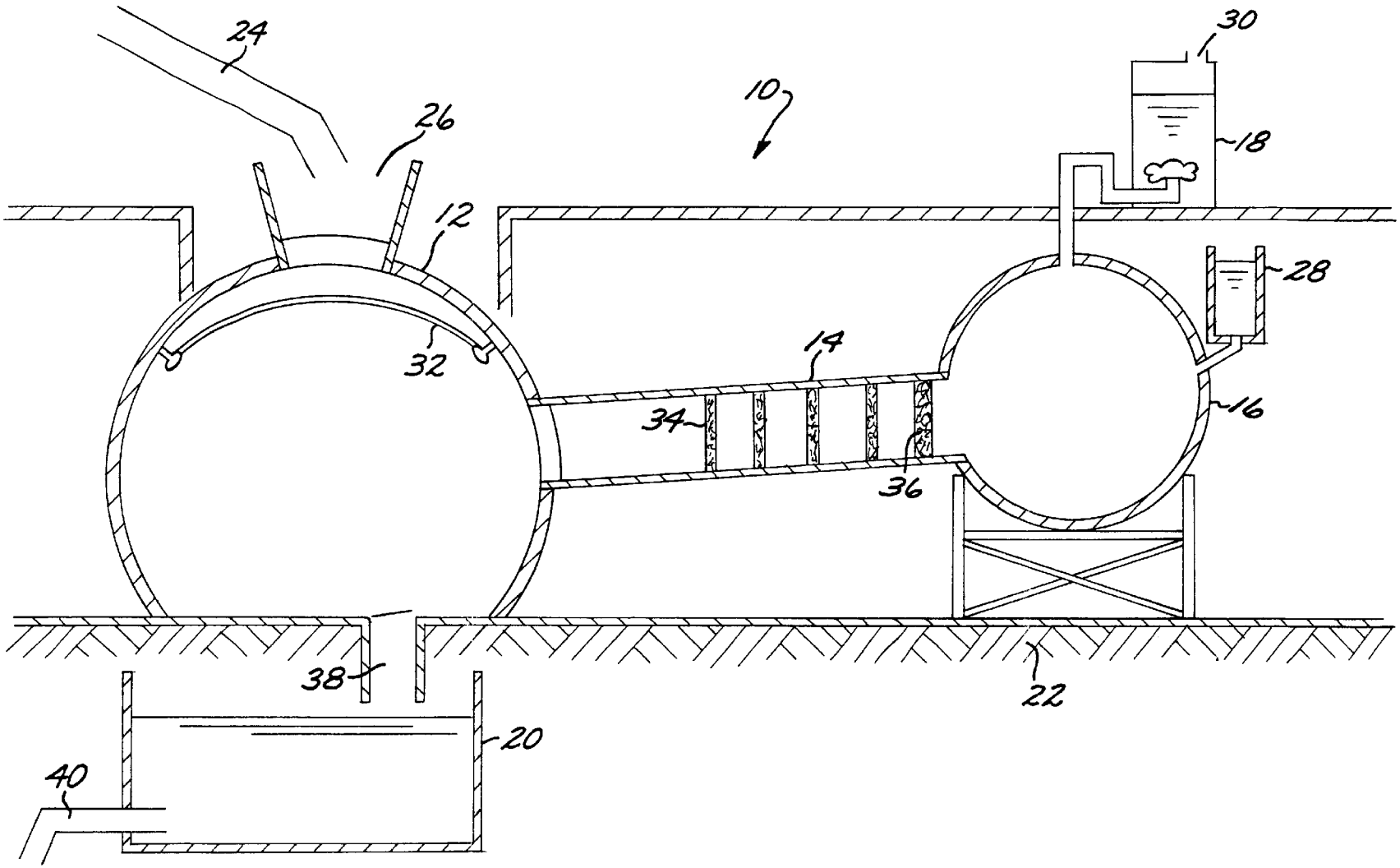
10
12
14
16
18
20
22
24
26
28
30
32
34
36
38
40

METHOD AND APPARATUS FOR DECOMPOSING AN INCINERATOR

This application is a division of application Ser. No. 09/139,073, filed Aug. 24, 1998, now U.S. Pat. No. 6,084, 149 (status, abandoned, pending, etc.).

BACKGROUND OF THE INVENTION

1. Field of the Invention

Melting incineration apparatus for detoxifying hazardous substances by using high frequency waves as a heat source and removing hazardous gas and hazardous inorganic compounds that are generated during melting by utilizing chain reactions.

2. Description of Prior Art

The concept of using the autoclave theory and high-temperature and high-pressure melting incinerator for removal of hazardous substances from waste material has been disclosed in the prior art. Conventionally, the melting furnaces have been used mainly for manufacture of new alloys, extraction of specific metal oxides from ore, and sterilization, etc. However, nothing has been made available for incineration of rubbish and waste based on the autoclave theory. Occasionally, substances whose water content is very low, (for instance, once incinerated substances or the like), can be incinerated in such a melting furnace again, or undergo secondary incineration, the technology being used only in a simple way for recycling residue (e.g. making ashes into bricks, etc.)

SUMMARY OF THE PRESENT INVENTION

The present invention utilizes a melting furnace that incorporates the autoclave theory and is equipped with a high-frequency (horizontal wave) device for incinerating material and for thermal decomposition and recrystallization of organic and inorganic hazardous compounds contained in it and to detoxify hazardous substances that have been recrystallized or thermally decomposed by using specific solvents. A melting furnace to accomplish the above is provided and hazardous gas that is generated during the incineration process at high temperature and under high pressure in the furnace is treated. In other words, the present invention is directed to providing a furnace that is equipped for the function of removing hazardous substances such as crystallization of halogen elements including chlorine.

Safety in handling and treating organic hazardous metals by the fixation method, including organic phosphorus, arsenic, antimony, and other elements (the 15th group in the periodical table) contained in the ashes generated from incineration by the melting furnace is also a concern of the present invention.

In order to make use of the high-frequency device with utmost efficiency and economy, water content in the waste is a potential problem. In the present invention, prior to the melting by high frequency waves, a facility for dehydration such as thermal dehydration by far infrared (wavelength 4 $\mu$m or longer) and generic drying methods is utilized. The reason far infrared rays are chosen source is to suppress generation of secondary pollutants (CO, $CO_2$, etc.) typically generated by other heat sources.

In this manner, a series of functional sections for the dehydration of waste, the incineration by a high-frequency melting furnace, safe handling and treatment of hazardous substances in the incinerated ashes, and treatment of organic gas during the melting process are provided as part of the apparatus of the present invention. Apparatus equipped with a high-frequency melting incinerator as part of a series of treatment processes is not available in the prior art. By treating hazardous substances applying the methods stated in the invention, secondary pollution is prevented from expanding to the air and the ground, and the inventive apparatus can be thus used for the prevention of environmental pollution.

DESCRIPTION OF THE DRAWING

For a better understanding of the invention as well as other objects and further features thereof, reference is made to the following description which is to be read in conjunction with the Sole drawing FIGURE.

Apparatus 10 of the present invention is shown in the FIGURE and comprises the following components:

Dome 12, which is an airtight incinerator furnace tolerant to high temperature and high pressure, based on the autoclave theory.

Tunnel section 14, which is the equipment for removing hazardous substances contained in the exhausted gas of dome 12, using magnesium for capturing substances other than methane and methylene.

Chamber 16, which is the equipment for treating hazardous substances (methane and methylene) with naphthol solution. A tall smokestack for treating exhaust gas is not required.

Agent reservoir 18, which is provided from the safety aspects, in case any hazardous substance cannot be treated in the dome 16.

Chamber 20 is an open-type solvent tank used for the decomposition of hazardous substances in the incinerated ash.

In the FIGURE, 22 refers to ground (in some cases, the equipment may be placed underground).

Conveyor device 24 for dumping industrial waste and household garbage having lower water content.

Waste is dumped into dome 12 at input section 26.

Agent reservoir 28 for chemical treatment in dome 16.

Smokestack 30, used as the outlet for exhaust gas after treatments generated during incineration.

High-frequency magnetic-field oscillation coil 32 for melting the waste material introduced into dome 12.

Magnesium filter 34 (heat-tolerant).

Fine-powdered pure iron filter 36.

Outlet 38 for exhausting oxide (ashes) after incineration for environmentally-safe fixation treatment; and Outlet 40 for exhausting incinerated ashes after the environmentally-safe fixation treatment with water content becomes somewhat higher because of solvent treatment.

DESCRIPTION OF THE INVENTION

Referring now to the FIGURE, in the first globular dome 12 of the apparatus, water contained in the waste material will evaporate and turn into hydrogen and oxygen ions by setting the temperature at 698° C. or higher subsequently reacting with carbon, sulfur, and chloride compounds, which are melted and vaporized inside the furnace, especially with metal oxides to result in various metal compounds. In addition, even transparent plastic films that cannot be melted by high-frequency waves (horizontal waves) will be incinerated by vertical waves that are generated by coil 32 along with the melting (in other words, combustion) of the substances contained in a sac or an enclosure of such transparent plastic film. However, it may be necessary to set a volume of waste to be treated for each session because plastic film swells when incinerated. On the other hand, when the interior furnace temperature reaches 750° C. or higher, elements start turning into ions, and the variety of ions will increase as the temperature goes up. In this manner, when the interior temperature reaches 1000° C. or higher, a thermal convection phenomenon will start with gaseous substances at an extremely high temperature in the furnace and ionized elements generated inside will begin to form secondary bonding. Most of the ions forming secondary bonding will be crystallized to deposit in the lower section mixed with the incinerated ashes.

Apparatus 34,36 is provided for removing hazardous substances using appropriate agents within the tunnel 14 between the first globular dome 12 and the second dome 16 as shown in the FIGURE.

The agents to be used for removing hazardous substances and the solvents to be used for removing specific metal ashes and hazardous gas (secondarily generated in the equipment) are as follows: (Solvent 1) 2-naphthol-4-sulfonic acid salt; (Solvent 2) The derivatives of the above-mentioned naphthol; (Solvent 3) 1-naphthylamine-4-sulfonic acid; (Solvent 4) The isomers of Solvent 3; (Solvent 5-1) Single-ring terpene; (Solvent 5-2) Double-ring terpene; (Solvent 5-3) Olefin, terpene. Metals and metal oxides to be used in the melting furnace are as follows: (Solvent 6) Magnesium (in a sand grain form); (Solvent 7) Fine granulated pure iron; (Solvent 8-1) Zeolite having a rhombic crystal structure (defined as hydrated alkali-aluminum silicates of the general formula $M_{2/n}O.Al_2O_3.ySiO_2.wH_2O$ where M represents a group IA or IIA element, n is the cation valence, y is 2 or greater and w is the number of water molecules contained in the channels or interconnected voids within the zeolite (Solvent 8-2) Complex metal oxides having a spinel structure such as, barium-titanium oxide ($BaTiO_3$), barium-tin oxide ($BaSnO_3$) and calcium-zirconium oxide ($CaZrO_3$). The environmentally-safe fixation of hazardous substances by adsorption with the solvents and specific metals set forth hereinabove thus results.

The reactor furnace for environmentally-safe fixation hazardous substances through crystallization by lowering temperature and by reacting with the agents in the second globular dome 16 of the apparatus is shown in the FIGURE. In other words, a device (not shown) to spray (Solvent 1) toward the center of the furnace is provided.

For removal of methane and hydrogen sulfide in a gaseous form that passed through the furnace 12 regardless of high temperature and high pressure, the use of the agents and the apparatus for the removal are employed.

The reason why the melting furnace 12 is globular shaped is because that high-temperature and high-pressure gas are generated during incineration; and that it is a most stable shape that will stand against vaporization pressure of water contained in the raw material to be incinerated.

Using the above procedure and apparatus, hazardous substances can be not only incinerated but also removed by use of the invention 10.

By using the apparatus and the specific adsorbents and agents as stated above, exhaust gas from the melting furnace 12 can be continuously neutralized and detoxified. At the same time the ashes can be treated in a safe and stable manner to leave no secondary pollution.

In the embodiment shown in the FIGURE, household garbage and industrial waste are treated. Dome 12 (first furnace) and the dome 16 (second furnace) provides for dehydration and drying.

The following design parameters are utilized in implementing the invention; (1) When using far infrared ray as the heat source for drying, the wavelength must be 4 um or longer; (2) a high-frequency induction furnace is used; (3) average number of calories (thermal energy) of water is 4,190 Joule; (4) when selecting the material for the interior wall as well as strength of the furnace body, the Boyle-Charles law is used; in this regards, tungsten steel plate was chosen as the preferred material for the interior wall of the furnace; (5) gas constant is $R=8.3144\times10^7$ ergs per ° C. per mole, according to Avogadro's law; (6) temperature required for obtaining thermoelectrons (operational temperature) is 1000≈1200°K.; (7) Since secondary exothermal reaction in the first furnace 12 may vary depending on the type of substance to be melted, a thermometer (not shown) is placed on the wall of the first furnace 12 so as to keep temperature between 454° C. ≈500° C.) and to induce reactants into the first furnace 12, not exceeding the melting temperature of magnesium filter 34 in the tunnel 14, i.e. 656° C.

The process steps are as follows:

Furnace 12: household garbage and industrial waste are dehydrated and dried by far-infrared heating and introduced to dumping window, or opening, 44. After dumping, power to initiate irradition of the household garbage and industrial waste to high-frequency heat treatment is turned on. Water contained in the raw material is completely decomposed and rapidly converted into secondary ions (of oxygen and hydrogen), when the heating temperature reaches around 700° C. Further, these ions will react and recombine with the group of molecules and atoms generated by melting of other substances and be incinerated into ashes through exothermal reaction. In other words, due to the autoclave reaction, interior temperatures in the furnace 12 elevate rapidly, and in one example, reached up to 2000° C. As a result, sulfur oxide, hydrogen, arsenic compounds, mercury compounds, phosphorus compounds, methyl group, chloride, nitrogen oxide, oxygen, carbon, carbon monoxide, and carbon dioxide are generated. Among them, part of arsenic, mercury, and phosphorus will form oxides and hydrides and deposit to become ashes. Then, arsenic compounds, phosphorus compounds, and methyl group, etc. in the remaining portion will be conveyed to the tunnel 14 and subsequently be adsorbed by the device 36 made of fine-powdered pure iron and that of red-hot magnesium that is prepared and heated by heat ventilation from the first furnace 12. Devices 32 having internal magnesium are placed in parallel along the tunnel, 14 forming a multiple-layered structure. The purpose of placing the devices 34,36 in parallel and in a multiple-layered (multiple-stacked) structure within the apparatus 14 is to give double and triple opportunities with heated gaseous components exhausted from the first melting furnace 12. In addition, it is designed to heat magnesium held inside the device 34 through the energy of heated gas. In other words, as the thermometer placed in the first furnace 12 detects temperature of about 500° C., the device for exhausting the gas to the tunnel section 14 (not shown) starts to work.

On the other hand, fine-powdered pure iron is packed in the last layer 36 of the multi-layered (multiple-stacked) devices, that is the one located closest to the second reactor furnace 16. This releases carbon from carbon dioxide that is reduced by red-hot magnesium and part of such carbon turns into carbon monoxide, entering into the second furnace 16; in order to remove carbon monoxide before the intrusion of carbon monoxide into the second furnace 16, fine-powdered pure iron is employed to remove carbon monoxide by forming iron carbonyl through reaction, introduced to the second furnace 16 in that state. At this point, the reason why fine-powdered pure iron 36 is used is because the volume of adsorbing carbon monoxide is more with pure iron than magnesium (Formula 1) (Note that the formulas are set forth in Appendix A attached hereto).

Tunnel Section 14: Sulfur deposits as magnesium sulfide after reacting with magnesium. The substances that are generated in the first furnace 12 and induced into the tunnel section 14 react with the red-hot heat magnesium to become the following substances: hydrogen becomes magnesium hydroxide and deposits (however, part of sulfur and hydrogen are induced to the second furnace 16); arsenic becomes arsenic magnesium and deposits; mercury becomes mercury magnesium and deposits; phosphorus becomes phosphorus magnesium and deposits; chloride becomes magnesium chloride and deposits (however, part of it may possibly be introduced to the second furnace); nitrogen becomes magnesium nitride and deposits (however, part of it may possibly be introduced to the second furnace 16); carbon becomes magnesium carbide. As described above, the process of forming reactants are exemplified in (Formula 2) and (Formula 3). In other words, various gas components generated in the first melting furnace 12, excluding those having hydrocarbon group, are mostly adsorbed by the red-hot magnesium and fine-powdered pure iron.

Second Furnace 16: The device for spraying (Solvent 1) into the solution is ready. The methyl group generated in the first furnace 12 fails to react with magnesium in the tunnel 14 but reacts with excessive sulfur and hydrogen to become mercaptan (thioalcohol), which is a non-toxic crystal. In the same manner, the cyan group reacts with (Solvent 1) solution, and is subsequently hydrolyzed. The details are described in copending application Ser. No. 09/138,951 filed Aug. 24, 1998, relating to a method for fixing heavy metals and soft muddy soil due to the crystallization of oxalate.

Exhaust Cooling apparatus (not shown) (located outside the melting furnace): For the apparatus, (Solvent 1) solution or (Solvent 2) solution is prepared in advance, and, if any residual substance remains in gas components exhausted from the second furnace 16, captures such substances. In addition, since no smokestack typically is provided for the apparatus, exhaust gas is passed through the solution. Assuming the case of mixing hydrocarbon such as methylene and the like into the cooling equipment, the function of fixing hydrocarbon by adding terpene liquid is provided.

As to the treatment of substance deposits in the tunnel section 14, they are treated in the order of (Solvent 1) solution, (Solvent 2) solution, and graphite. The details of the treatment is set forth in Copending Application Ser. No. 09/138,952 filed Aug. 24, 1998, now U.S. Pat. No. 5,986,161 concurrently herewith and directed to method for stable fixing heavy metals and semi-metals as well as soft muddy soil. For heating required as one of the conditions to promote the reaction mentioned above (condensation), heat from the tunnel section 14 and the second furnace 16 is used as the source.

The treatment of incinerated ashes should be completely done in the airtight chamber 20. The reason is to neutralize and detoxify hazardous gases formed by introducing again into (Solvent 3), assuming that the sulfur and chloride are vaporized during the process using (Solvent 1), (Solvent 2), and graphite material. The use of graphite is described in Copending application Ser. No. 09/138,952 filed Aug. 24, 1998, now U.S. Pat. No. 5,986,161 concurrently herewith).

Graphite inter-layer compounds have electron donors and receptors inserted in between the layers: the electron donors are alkaline metals, alkaline-earth metals, rare-earth metals (the III group of the periodical table Se, Y, lanthanide, etc.), and transition metals. Electron receptors are halogen, halogenated metals, metal oxides, oxygen acids, Lewis acids, etc. At the same time, these inter-layer compounds are insoluble in water, or cannot be decomposed by water.

The steps set forth hereinabove provide far more complete neutralization/ detoxification of hazardous substances. According to the invention, by use of the specific agents as well as the equipment, 10 it is possible to prevent secondary environmental pollution.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

APPENDIX A - FORMULA

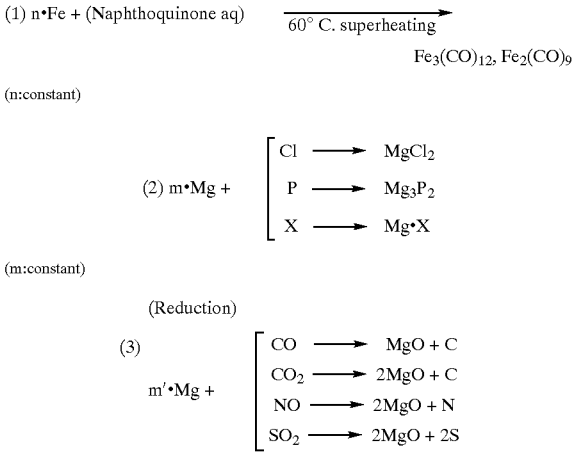

APPENDIX B TEST RESULTS

1. Zincon method: alpha-(5-vinyl-2-quinuclidinyl)-4-quinoline; alpha-(5-vinyl-2-quinuclidinyl)-4-quinoline methanol Note: Zincon is o-(2-[alpha-(2-hydroxy-5-sulonylazo)-benzulidene]-hidrazino)-benzoic acid.

Cinchonin ($C_{12}H_{22}N_2O$) HCl salt, white to pale yellow powder, and water-soluble. Forms precipitate with anionic complex and oxoate (tungstate) ion.
2. Griess revised method: The method using Griess reaction. The addition of alkaline metal to aminobenzene sulfonic acid, yielding sodium aminobenzene sulfonate, and sulfanyl acid (aminobenzene sulfonic acid). Colorimetric quantitative analysis of HONO ion (indicating the formation of azo dye)
3. Nessler method: Nessler's reagent, dissolving HgCl with iodine in boiled water, yielding $HgI_2$, then, $HgI_2$+Na(OH) to use supernatant.
4. Silver chloride (AgCl) turbidimetric method: Silver chloride will dissolve into hydrous ammonium, alkaline cyanide, chloric acid, and each water solution as complex salt ion, such as $[Ag(NH_3)_2]^+$, $[Ag(CN)_2]^+$, $[Ag(S_2O_3)_2]^+$, and $[AgCl]^-$. The presence of complex salt ions is shown as comparison.
5. DPCi method (made by Merk): Diphenylcarbozide (1,5-diphenyl carbonohydrazide) $C_{13}H_{14}N_9O_8$, to solubilize by adding alkaline metals for identifying [xxxx agent]. Colorimetric agent, gold, copper, mercury, and serene.

6. Cy-DTA method: γ-alumina, condition for heating is given.
7. O-trypsine method: $C_{14}H_{16}N_2$, 3,3'-dimethyl benxindine, react with chlorine in a water solution to colorize strongly, quantitative colorimetry of free chlorine.
8. Pyridine-pyrazolone reaction: Quantitative analysis of cyanogen, showing blue. PH 7→ add chlorimine T solution, and add the mixture of a solution of bis-(1-phenyl-3-methyl-5-pyrazolone) in pyridine and a solution of 1-phenyl-3-methyl-5-pyrazolone two to three minutes later, then leave for a while.
9. Piclinic acid $C_6H_3N_3O_7$: 2,4,6-trinitrophenol, CAS [98-98-6]
10. Pherone method: 8-hydroxy-7-iondoquinoline-5-sulfonic acid, due to the presence of sulfonic acid group, dissolved into water as complex anion. Fe, $V^{cr}$ quantitative colorimetric analysis. CAS [547-01-0].
11. PAR method, $C_{11}H_9N_3O_2$: [4-(2-pyridylazo)-resorcinol], CAS [1141-59-9] (pH complex) retaining complex: treat diatomaceous earth with silane (silica gel), forming complex
12. DDT: meta-arsenious acid ($M'AsO_2$), cooled with water to generate arsenious ion ($As(OH)_3$); $As(OH)_3$+ $CuCl_2$→Cu(II)$HAsO_3$(arseneous copper) (green)
13. Ni: 94% $SiO_2$+6% $H_2O$) diatomaous earth and monositene ($SiH_4$), in a broad meaning, treat with silane ($SinH_2n+_2$) type compound. As reducing agent, a) lithium hydrogen aluminum and b) sodium hydrogen aluminum can be used. Silane is gas having odor, bp=−112° C. and mp.=−185° C., d(liquid): 0.68, gas
14. Fluorine: NMR analyzer (having NMR functions) NMR: Pulse-Fourier conversion function; a method for measuring resonance energy absorption from radio frequency oscillating magnetic field.
15. Boron: Using boron catalyst according to Green's method. A) Electric stone B) fluorite→($CaF_2$)+ $KHSO_4$→mix them 1:3 ratio→boric acid agent
16. Phosporic acid: aluminic acid salt (general formula, ($M'_2O$)×($Al_2O_3$)y) a) ortho-aluban $M'_2Al_2O_3$ b) meta-aluban $M'AlO_2$; No evidence for the presence of aluminic acid ion, double salt o-hydroxo aluminonic acid complex; double oxide, no presence of oxo acid on due to the change of structure. (Examples) FeIIFeIIIO4, BeTiO3, spinel type, MgAl2O4, FeCr2O4, ZnAl2O4, CoIICoIIIO4; hydroxo alumine"hydoxo coodinant, a complex that part of OH— is coordinated. Aqueous complex of metal ions are consecutively hydrolyzed in water solution as follows: [M(H2O)x]n+/===/ [M(OH)(H2O)x−1](n−1)+H+/===/[M(O)2(H2O)z−2](n−2) /==. . . As shown above, hydroxo complex is formed, which subsequently turns into oxo complex by releasing proton in a basic solution.
17. Phenol: Ferric chloride $FeCl_4$ (purple)

Manufactured in 1973 (Transformer Fluid for Power Transmission) Additional Component Analysis Done for That Manufactured in 1993

[B] Organic Solvent (P) One hour after the completion of the fifth step
Fifth Step (one hour after completion)

| Inspection Item | Frist | Second | Lower Limit (mg/l) Of measurement |
|---|---|---|---|
| 1. Nitrous nitrogen | n/s | n/s | 0.01 |
| 2. Chlorine (low level) | n/s | n/s | 0.5 |
| 3. Residual chlorine | n/s | 0.02 | 0.02 |
| 4. Fluorine | n/s | n/s | 0.05 |
| 5. Boron | n/s | n/s | 0.05 |
| 6. Phosphate | n/s | n/s | 0.05 |

-continued

| | | | |
|---|---|---|---|
| 7. Phenol | n/s | 0.1 | 0.1 |
| 8. Total cyan | n/s | n/s | 0.1 |

Seventh Step (1.5 hour after the completion of the fifth step)

| Inspection Item | Frist | Second | Time (minutes) | Solvent Used |
|---|---|---|---|---|
| 1. Nitrous nitrogen | 0 | 0 | 16 | |
| 2. Chlorine (low level) | 0 | 0 | 3 | |
| 3. Residual chlorine | 0 | 0 | 7 | |
| 4. Fluorine | 0 | 0 | 10 | |
| 5. Boron | 0 | 0 | 20 | |
| 6. Phosphate | 0 | 0 | 20 | |
| 7. Phenol | 0 | 0 | 6 | |
| 8. Total cyan | 0 | 0 | 18 | Piclinic acid |

* n/s: not shown
Specimen volume per run: 20 ml
Instrument: Digital spectrophotometer
Cyan include cyanogen and cyanide.

TABLE A

| | Inspection Item | Frist | Second | Lower Limit (mg/l) Of measurement |
|---|---|---|---|---|
| | Fifth Step (one hour after completion) | | | |
| I | 2. Nitrous-nitrogen | 0.02 | 0 | 0.01 |
| II | 3. Ammonium-nitrogen | 0 | 0 | 0.05 |
| III | 4. Chlorine (low level) | 0 | 0 | 0.5 |
| IV | 5. Chromium (IV) | 0 | 0 | 0.01 |
| V | 7. Residual chlorine | 0.02 | 0.02 (pale yellow) | 0.02 |
| VI | 11. Copper (Cu) | 0 | 0 | 0.05 |
| VII | 12. Lead (Pb) | 0 | 0 | 0.05 |
| VIII | 14. Fluorine | 0 | 0 | 0.05 |
| IX | 15. Boron | 0 | 0 | 0.05 |
| X | 16. Phosphate ($PO_4$) | 0 | 0.05 (pale blue) | 0.05 |
| XI | 17. Phenol | 0 | 0.1 | 0.1 |
| XII | 9 Total cyan | 6 | 0 | 0.1 |

| Inspection Item | Frist | Second | Time | Solvent Used |
|---|---|---|---|---|
| Sixth Step (1.5 hour after the completion of the fifth step) | | | | |
| I | 0 | 0 | 16 | Cinconin HCl salt |
| II | 0 | 0 | 4 | Sodium aminobenzene sulfonate |
| III | 0 | 0 | 3 | Silver chloride |
| IV | 0 | 0 | 5 | Diphenyl carbezide |
| V | 0 | 0 | 10 | 3,3'-dimethyl benzine |
| VI | 0 | 0 | 5 | Sodium meta-arsenous acid salt |
| VII | 0 | 0 | 5 | [4-(2-pyrridylazooresocinol)] |
| VIII | 0 | 0 | 7 | NMR |
| IX | 0 | 0 | 20 | Fluorite + Potassium hydrogensulfate (1:3) |
| X | 0 | 0 | 20 | Sodium aluminate |
| XI | 0 | 0 | 6 | Ferric chloride |
| XII | 0 | 0 | 18 | Piclinic acid method |

Specimen volume: 25 ml per run
Instrument: digital spectrophotometer
The figures described above are for the fixation of soil.
For the fixation of heavy metals, no lower limits are shown with all items.

Water Quality Tester—Made By Kyoritsu Physico-Chemistry Laboratories Digital Water Tester (Rambda 2000/6000) Two Units Detection Method: A Digital Photoelectric Tester That Converts Absorbency Based on Reagent Colorization Into Concentration Unit: mg/l/ppm Photo-receptor: silicone diode Speciment volume: 25 ml

| Measurement Items: (based on the above instrument) | | | |
|---|---|---|---|
| | Range (mg/l) | Method | Time (in minute) |
| 1. Zinc | 0.05 ~ 2.0 | Zincon method | 8 |
| 2. Nitrous acid (nitrous nitrogen) | 0.01 ~ 0.5 | Revised Griess mehod | 16 |
| 3. Ammonium (ammonium nitrogen) | 0.05 ~ 5.0 | Nessler method | 4 |
| 4. Chlorine (low level) | 0.5 ~ 2.0 | AgCl turbimetry | 3 |
| 5. Chromium (IV) | 0.01 ~ 1.0 | DPC method | 5 |
| 6. Chromium (III) | 5.0 ~ 100 | CyDTA method | 20 |
| 7. Residual chloride (ClO) | 0.02 ~ 1.0 | o-tridine method | 10 |
| 8. Free cyanide (CN) | 0.01 ~ 0.5 | Pyridin-pyrazolone | 24 |
| 9. Total cyanide | 0.1 ~ 2.0 | Piclinic acid method | 18 |
| 10. Iron (III) | 0.1 ~ 10.0 | Feron method | 5 |
| 11. Copper (Cu) | 0.05 ~ 4.0 | Cu-DDTC method | 5 |
| 12. Lead (Pb) | 0.05 ~ 10.0 | PAR method | 5 |
| 13. Nickel (Ni) | 1.0 ~ 10.0 | DG method | 10 |
| 14. Fluorine (F) | 0.05 ~ 2.0 | ECR method | 7 |
| 15. Boron (B) | 0.05 ~ 2.0 | [Kluckmer] method | 20 |
| 16. Phosphate ($PO_4$) | 0.05 ~ 2.0 | Molybudenum-blue method | 20 |
| 17. Phenol | 0.1 ~ 5.0 | [Aminoanhiol] method | 6 |

What is claimed is:

1. Apparatus for detoxifying hazardous substances comprising:

airtight incineration means tolerant of high reaction temperatures and pressures for containing said hazardous substances during incineration;

high frequency magnetic field coil means positioned within said incineration means for inducing incineration of said hazardous substances such that an application of power to said high frequency magnetic coil means induces incineration of said hazardous substances to produce ash and a gas;

temperature control means within said incineration means for maintaining the temperature within said incineration means between about 454 and 500° C.;

tunnel filter means leading from said incineration means for initial removal of hazardous substances from said gas;

exhaust means for exhausting gas from said incineration means into said tunnel filter means when the temperature in said incineration means is approximately 500° C.;

gas treatment means connected to the end of said tunnel filter means for secondary removal of hazardous substances from said gas;

exhaust cooling means connected to said gas treatment means for final removal of hazardous substances from said gas;

input means for introducing said hazardous substances to said incineration means; and outlet means for removing said ash from said incineration means.

2. The apparatus of claim 1 in which said tunnel filter means contains a plurality of laminar magnesium filters and a final iron filter.

3. The apparatus of claim 2 in which said magnesium filters contain magnesium in sand grain form.

4. The apparatus as claimed in claim 2 in which said iron filter contains fine, granulated pure iron.

5. The apparatus of claim 1 in which said gas treatment means comprises equipment for spraying said gas with a solution of 2 naphthol-4-sulfonic acid salt.

6. The apparatus of claim 1 in which said exhaust cooling means comprises means for conveying said gas through a solution made from a chemical selected from the group consisting of 2 naphthol-4-sulfonic acid salt and derivatives of 2 naphthol-4-sulfonic acid salt.

7. The apparatus of claim 1 in which said incineration means and gas treatment means are essentially globular.

8. Apparatus for detoxifying hazardous substances comprising:

an incineration furnace which is airtight and tolerant of high reaction temperatures and pressures;

a high frequency magnetic field coil within said incineration furnace such that an application of power to said high frequency magnetic coil means induces incineration of said hazardous substances to produce ash and a gas;

a temperature controller within said incineration furnace for keeping the temperature within said incineration furnace between about 454° C. and 500° C.;

a tunnel leading from said incineration furnace;

means for exhausting said gas from said incineration furnace into said tunnel when the temperature in said incineration furnace is about 500° C.;

a plurality of laminar magnesium filters and a final iron filter within said tunnel;

a gas treatment furnace connected to the end of said tunnel;

means for spraying said gas with a solution of 2 naphthol-4-sulfonic acid salt within said gas treatment furnace; and smokestack means connected to said gas treatment furnace for conveying said gas through a solution made from a chemical selected from the group consisting of 2 naphthol-4-sulfonic acid salt and derivatives of 2 naphthol-4-sulfonic acid salt; and said incineration furnace having an input section for introducing said hazardous substances to said incineration furnace and an outlet section for removing said ash from said incineration furnace.

9. An apparatus as claimed in claim 8 in which said magnesium filter contains magnesium in sand grain form.

10. An apparatus as claimed in claim 8 in which said iron filter contains fine, granulated pure iron.

11. An apparatus as claimed in claim 8 in which said incineration furnace and gas treatment furnace are essentially globular.

12. A method of treating hazardous substances comprising the steps of:

providing an incineration furnace which is airtight and tolerant of high reaction temperatures and pressures, said incineration furnace having an input section and an outlet section;

installing a high frequency magnetic field coil and a temperature controller within said incineration furnace;

providing a tunnel leading from said incineration furnace;

providing a plurality of laminar magnesium filters and a final iron filter within said tunnel;

providing means for exhausting gas from said incineration furnace into said tunnel when the temperature in said incineration furnace is about 500° C.;

providing a gas treatment furnace connected to the end of said tunnel;

providing a smokestack connected to said gas treatment furnace;

introducing said hazardous substances to said incineration furnace via said input section;

applying power to said high frequency magnetic coil thereby inducing incineration of said hazardous substances to produce ash and said gas;

maintaining the temperature within said incineration furnace between about 454° C. and 500° C.;

conveying said gas into said tunnel when the temperature within said incineration furnace is approximately 500° C.;

spraying said gas with a solution of 2 naphthol-4-sulfonic acid salt within said gas treatment furnace;

conveying said gas through a solution made from a chemical selected from the group consisting of 2 naphthol-4-sulfonic acid salt and derivatives of 2 naphthol-4-sulfonic acid salt in said smokestack; and removing said ash from said incineration furnace via said outlet section.

13. The method as claimed in claim 12 further comprising the step of pre-drying said hazardous substances by far infrared heating prior to introducing said hazardous substances to said incineration furnace.

* * * * *